US005619007A

United States Patent [19]

Mena et al.

[11] Patent Number: 5,619,007

[45] Date of Patent: Apr. 8, 1997

[54] BICYCLE MOUNTED BULLETPROOF ARMOR SHIELD SYSTEM

[76] Inventors: Daniel Mena, 2042 A Villa Del Lago Dr., Chino Hills, Calif. 91709; George Martinez, 6151 Riverside Ave., Huntington Park, Calif. 90255

[21] Appl. No.: 669,025

[22] Filed: Jun. 24, 1996

[51] Int. Cl.[6] ..... F41H 5/14

[52] U.S. Cl. ..... 89/36.09; 89/36.07

[58] Field of Search ..... 89/36.09, 36.07, 89/36.08, 36.01

[56] References Cited

U.S. PATENT DOCUMENTS 1,234,174 7/1917 Kempny ..... 89/36.09

2,401,245 5/1946 Hobbs ..... 89/36.09

4,781,101 11/1988 Zevuluni et al. ..... 89/36.09

*Primary Examiner*—J. Woodrow Eldred

*Attorney, Agent, or Firm*—Robert T. Spaulding

[57] ABSTRACT

A bicycle mounted bulletproof armor shield system comprising a bicycle and two triangularly shaped body structures, the first structure is dimensioned to be contained within the area of the bicycle defined by the top tube, the down tube and the seat tube. The second structure is dimensioned to be contained within the area of the bicycle defined by the seat tube, the seat stay and the chain stay. Both structures are made of a bulletproof material. Handles are provided on the first body structure to facilitate positioning.

5 Claims, 1 Drawing Sheet

BICYCLE MOUNTED BULLETPROOF ARMOR SHIELD SYSTEM

BACKGROUND OF THE INVENTION

1) Field of the invention.

This invention relates generally to bulletproof armor protection systems and more specifically to a system which is mounted to a bicycle frame.

2) Description of the prior art.

Bulletproof armor protection systems are available to shield the occupants of a helicopter, as shown in U.S. Pat. No. 5,448,938, and to shield the front seat occupants of a vehicle as shown in U.S. Pat. No. 5,438,908. Portable shields are available which may be carried by individuals as shown in U.S. Pat. No. 5,392,686. Other portable shields are available which also function as clipboards, such as described in U.S. Pat. No. 4,919,037. Consequently, methods for protecting a peace officer from hazardous gunfire are well known in the art.

However, peace officers are now using a new form of transportation, the bicycle, which has greatly enhanced their ability to perform their duties.

Unfortunately, peace officers on bicycles are extremely vulnerable to gunfire. There is simply no room on the bicycle for an enveloping armor protection system; a vest of the "flak jacket" type is out of the question, and a clipboard or portable shield is too bulky and cumbersome.

Accordingly, one object and advantage of this invention is to provide a bulletproof armor shield system which is incorporated within the framework of the bicycle itself.

Another object and advantage of this invention is that the armor shield system is always available to the bicycle rider: This is not a system which may be forgotten at the station or left at a previous call.

Another object and advantage of this invention is that the armor shield system is instantly available, the peace officer needs only to dismount from the bicycle on the side away from the perceived threat and assume a crouching position.

Another object and advantage of this invention is that by grasping a handle which is an integral part of the system,the peace officer may move the bicycle, and hence the system, to a more advantages location while remaining protected.

Further objects and advantages of this invention will become apparent from consideration of the drawings and ensuing description of it.

SUMMARY OF THE INVENTION

The present invention comprises a bicycle and two triangularly shaped body structures which are composed of a bulletproof material. One of the body structures is dimensioned to be confined within the area of the bicycle defined by the top tube, the down tube, and the seat tube. The other body structure is dimensioned to be confined within the area defined by the seat tube, the seat stay, and the chain stay. The two body structures are held in place by suitably located attaching points. A handle is located on each side of the body structure which is contained by the top tube, the down tube, and the seat tube. The handles are located near the center Of gravity of the bicycle in order to enhance the ability of the peace officer to manipulate the system while minimizing the exposure to hazardous fire.

In response to a real or perceived threat of a firefight, a patrolling peace officer needs only to dismount from the bicycle on the side away from the danger and assume a crouching position. By grasping the nearest handle located on the body structure, the peace officer may adjust or re-locate the bulletproof armor shield system to provide maximum protection while maintaining the crouching position.

DESCRIPTION OF THE PREFERRED EMBODIMENT

Figure 1:
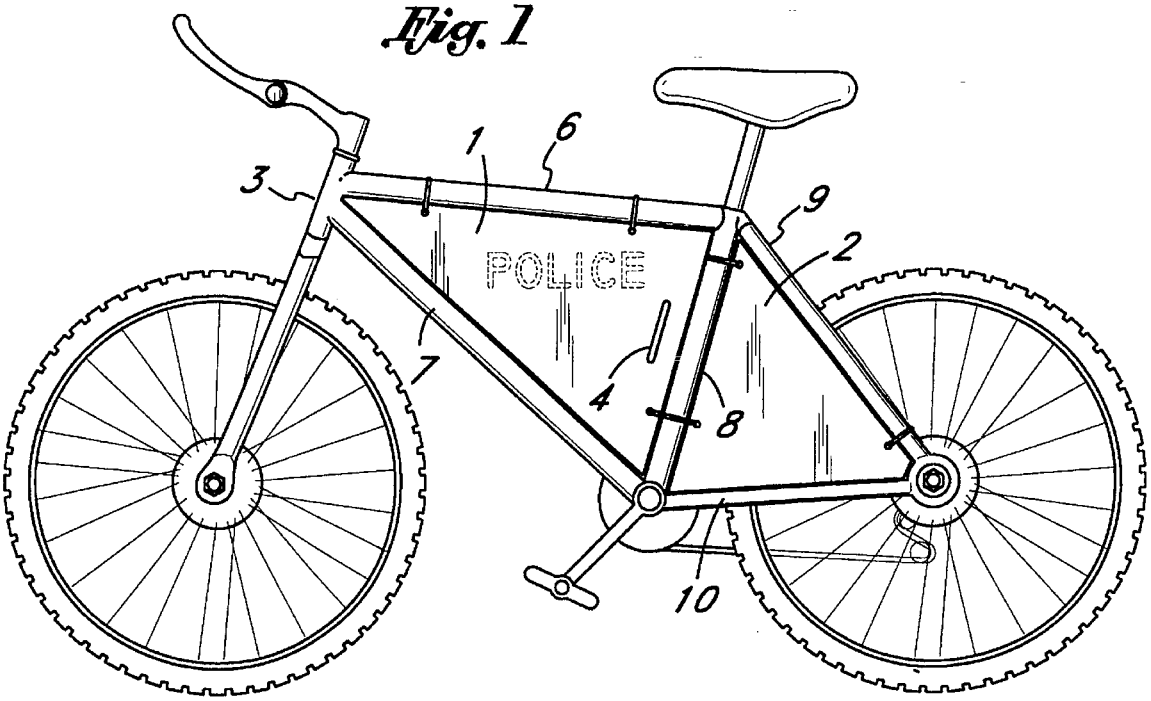
FIG. 1 shows a side view of the bicycle mounted bulletproof armor shield system in which the first triangularly shaped body structure 1, and the second triangularly shaped body structure 2 may be seen as they are attached to the bicycle 3. Further, one of the handles 4 may be seen. Also visible are the top tube 6, the down tube 7, the seat tube 8, the seat stay 9 and the chain stay 10, which are the components of the bicycle frame which encompass the two body structures, and to which the body structures are attached.

FIG. 1 defines the bicycle mounted bulletproof armor shield system by illustrating the relationship between the bicycle 3, the first triangularly shaped body structure 1, and the second triangularly shaped body structure 2. As may be seen, the first triangularly shaped body structure is dimensioned to occupy the area of the bicycle frame defined by the top tube 6, the down tube 7, and the seat tube 8. In like manner, the second triangularly shaped body structure 2 is dimensioned to be contained within the area of the bicycle defined by the seat tube 8, the seat stay 9, and the chain stay 10.

The two body structures are composed of a bulletproof material typically of the aramid fibers such as, but not limited to, the trademarked "KEVLAR" product or the HEXGARD F-401F aramid system. The material chosen may be predicated by the requirements of the acquiring law enforcement agency.

Figure 2:
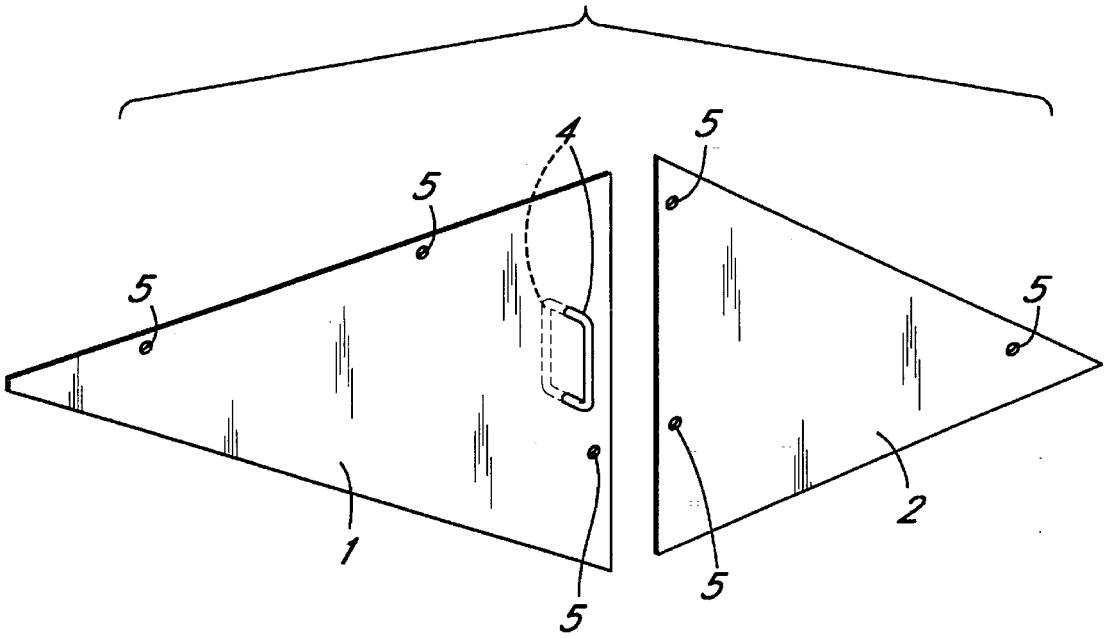
FIG. 2 shows a side view of the unattached first body structure 1 and the second body structure 2. The location of two handles 4 may also be seen as well as a number of mounting holes 5 which are located about the edges of the two body structures to facilitate attachment.

FIG.2 shows a side view of the unattached body structures. In this view, the location of two handles 4 may be seen, one on the near side and one on the far side of the first triangularly shaped body structure 1. The handles are located about the center of gravity of the system in order to aid in positioning the system during use. Also shown are a number of attaching holes 5, which facilitate the means to attach the two body structures.

Based on the description of FIG. 1 and FIG. 2, it can be seen that a patrolling peace officer, when confronted by danger, needs only to step off the bicycle mounted bulletproof armor shield system on the side away from danger. By grasping a handle and assuming a crouching position, the officer will have the most critical body parts covered while leaving a hand free to return fire.

Although the description above contains many specifications, these should not be construed as limiting the scope of the invention, but as merely providing illustrations of some of the presently preferred embodiments of this invention. Thus the scope of the invention should be determined by the appended claims and their legal equivalents, rather than by the examples given.

What is claimed is:

1. A bicycle mounted bulletproof armor shield system comprising:

a bicycle, including a frame consisting of a top tube, a down tube, a seat tube, a seat stay, and a chain stay;

a first triangularly shaped body structure, dimensioned to occupy the area of the frame defined by the top tube, the down tube, and the seat tube;

a second triangularly shaped body structure, dimensioned to occupy the area of the frame defined by the seat tube, the seat stay, and the chain stay;

at least one handle, located on the first triangularly shaped body structure whereby the bicycle mounted bulletproof armor shield system may be grasped and manipulated.

2. The first and second body structures of claim 1, in which the body structures are composed of a bulletproof material.

3. The first body structure of claim 1, further including means to attach said body structure to the top tube, the down tube, and the seat tube.

4. The second body structure of claim 1, further including means to attach said body structure to the seat tube, the seat stay, and the chain stay.

5. A bicycle mounted bulletproof armor shield system consisting of a bicycle including a top tube, a down tube, a seat tube, a seat stay, and a chain stay; two triangularly shaped body structures, each composed of a bulletproof material, one structure dimensioned to be contained within the area defined by the top tube, the down tube, and the seat tube, the other structure dimensioned to be contained within the area defined by the seat tube, the seat stay, and the chain stay; and at least one handle, mounted to the body structure contained within the area defined by the top tube, the down tube, and the seat tube which allows manipulation of said system.

* * * * *